US011289264B2

(12) United States Patent
Lim et al.

(10) Patent No.: US 11,289,264 B2
(45) Date of Patent: Mar. 29, 2022

(54) INDUCTOR

(71) Applicant: SAMSUNG ELECTRO-MECHANICS CO., LTD., Suwon-si (KR)

(72) Inventors: Sung Jun Lim, Suwon-si (KR); Yeong Min Jeong, Suwon-si (KR); Kyung Ho Lee, Suwon-si (KR); Han Kim, Suwon-si (KR); Sang Jong Lee, Suwon-si (KR); Su Bong Jang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 282 days.

(21) Appl. No.: 16/190,993

(22) Filed: Nov. 14, 2018

(65) Prior Publication Data

US 2019/0355508 A1 Nov. 21, 2019

(30) Foreign Application Priority Data

May 18, 2018 (KR) ..... 10-2018-0057163

(51) Int. Cl.
*H01F 17/00* (2006.01)
*H01F 27/28* (2006.01)
*H01F 27/30* (2006.01)

(52) U.S. Cl.
CPC ..... *H01F 27/2852* (2013.01); *H01F 27/30* (2013.01)

(58) Field of Classification Search
CPC ..... H01F 17/0006; H01F 17/0013; H01F 27/2804; H01F 27/2809; H01F 27/2852;
(Continued)

(56) References Cited

U.S. PATENT DOCUMENTS 6,452,473 B1 * 9/2002 Suzuki ..... H01F 17/0013 336/200
2008/0157913 A1 7/2008 Kim
(Continued)

FOREIGN PATENT DOCUMENTS

CN 104658739 A 5/2015
JP 2003-332131 A 11/2003
(Continued)

OTHER PUBLICATIONS

Korean Office Action dated Jun. 22, 2019 issued in Korean Patent Application No. 10-2018-0057163 (with English translation).
(Continued)

*Primary Examiner* — Tszfung J Chan
(74) *Attorney, Agent, or Firm* — Morgan, Lewis & Bockius LLP

(57) ABSTRACT

An inductor includes a body in which a plurality of insulating layers on which a plurality of coil patterns are arranged are stacked, and first and second external electrodes disposed on an external surface of the body, wherein the plurality of coil patterns are connected through coil connecting portions and include coil patterns disposed on an outer side and coil patterns disposed on an inner side thereof, a coil pattern disposed on the inner side adjacent to the coil pattern disposed on the outer side includes two coil connecting portions spaced apart from each other and facing each other in a length direction of the body, and a dummy electrode pattern is further disposed in a void portion between two coil connecting portions.

18 Claims, 3 Drawing Sheets

(58) Field of Classification Search
CPC ..... H01F 27/292; H01F 27/30; H01F 27/32; H01F 27/323
USPC ..... 336/200, 232
See application file for complete search history.

(56) References Cited

U.S. PATENT DOCUMENTS

| | | | | |
|---|---|---|---|---|
| 2012/0188682 | A1* | 7/2012 | Sato | H01G 4/232 361/305 |
| 2014/0145815 | A1* | 5/2014 | Ishii | H01F 27/292 336/200 |
| 2015/0137929 | A1 | 5/2015 | Park | |
| 2015/0340150 | A1* | 11/2015 | Nakamura | H01F 17/0013 336/200 |
| 2016/0086719 | A1* | 3/2016 | Jeong | H01F 27/292 174/260 |
| 2017/0103846 | A1* | 4/2017 | Yoneda | H01F 27/2804 |
| 2018/0012696 | A1 | 1/2018 | Lee et al. | |

FOREIGN PATENT DOCUMENTS

| | | | |
|---|---|---|---|
| JP | 2011-029222 | A | 2/2011 |
| KR | 10-0869741 | B1 | 11/2008 |
| KR | 10-2016-0033464 | A | 3/2016 |
| KR | 101670184 | B1 * | 10/2016 |
| KR | 10-2018-0006246 | A | 1/2018 |

OTHER PUBLICATIONS

Chinese Office Action dated Dec. 3, 2020 issued in Chinese Patent Application No. 201910057168.9 (with English translation).

* cited by examiner

I–I'

INDUCTOR

CROSS-REFERENCE TO RELATED APPLICATION

This application claims benefit of priority to Korean Patent Application No. 10-2018-0057163 filed on May 18, 2018 in the Korean Intellectual Property Office, the disclosure of which is incorporated herein by reference in its entirety.

TECHNICAL FIELD

The present disclosure relates to an inductor.

BACKGROUND

Recent smartphones have been implemented with the ability to use many frequency bands due to the application of multiband long term evolution (LTE). As a result, high frequency inductors are largely used as impedance matching circuits in signal transmission and reception RF systems.

Recently, high frequency inductors have been required to be compact and to have high capacity.

That is, due to the requirements for miniaturization and maintenance of existing capacity, the design of circuits of high frequency inductors is complicated and a line width and thickness of coil patterns tend to be reduced.

High-frequency inductors are manufactured by forming coil patterns on a plurality of insulating layers, stacking the layers, and subsequently compressing the same at high temperature and high pressure.

However, in the process of designing high-frequency inductors, a void may be formed between the coil patterns. When compressing is performed at a high temperature and high pressure as mentioned above, the coil patterns may be depressed as the void is filled with an insulating material.

Depression of the coil patterns may degrade reliability and electrical characteristics of the inductors, and thus, improvements may be required.

SUMMARY

An aspect of the present disclosure may provide an inductor having excellent reliability by preventing depression of a coil pattern.

According to an aspect of the present disclosure, an inductor may include: a body in which a plurality of insulating layers on which a plurality of coil patterns are arranged are stacked; and first and second external electrodes disposed on an external surface of the body, wherein the plurality of coil patterns are connected through coil connecting portions and include a coil pattern disposed on an outer side of the body and a coil pattern disposed on an inner side of the body, the coil pattern disposed on the inner side adjacent to the coil pattern disposed on the outer side includes two coil connecting portions spaced apart from each other and facing each other in a length direction of the body, and a dummy electrode pattern is disposed between the two coil connecting portions.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
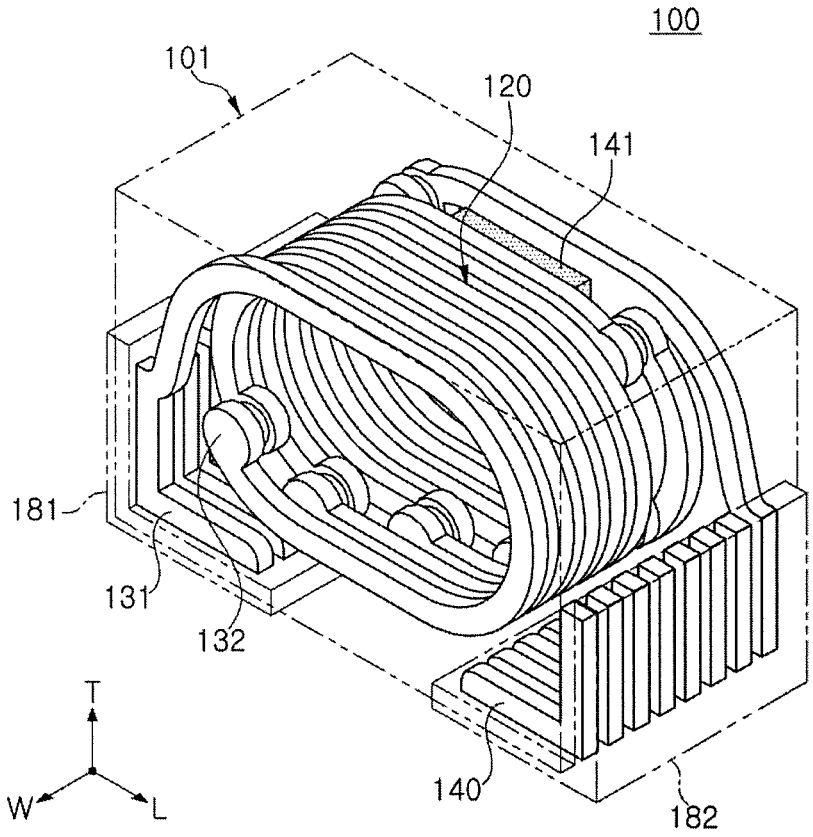
FIG. 1 is a schematic perspective view of an inductor according to an exemplary embodiment in the present disclosure.

Exemplary embodiments of the present disclosure will now be described in detail with reference to the accompanying drawings FIG. 1 is a schematic perspective view of an inductor according to an exemplary embodiment in the present disclosure.

Figure 2:
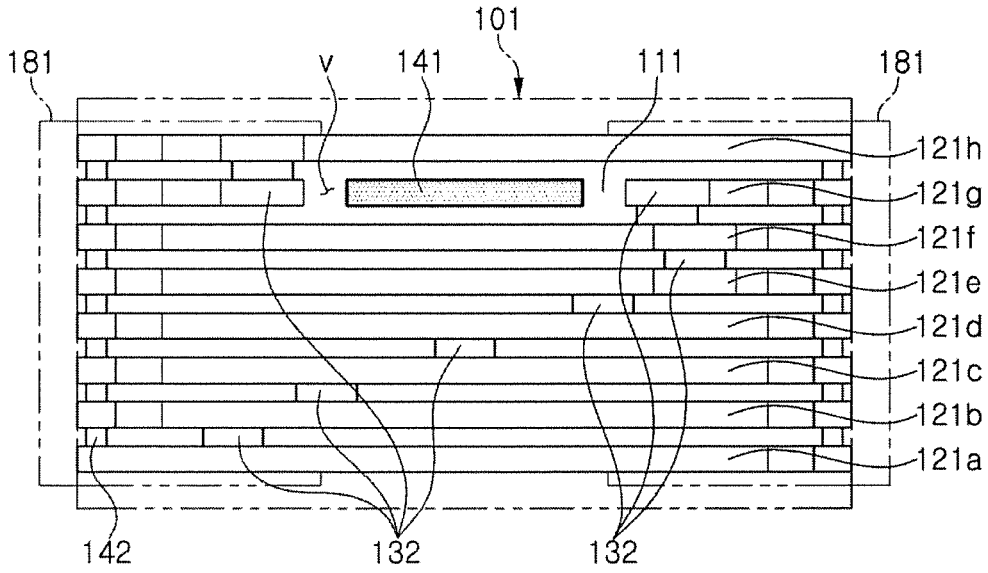
FIG. 2 is a schematic perspective plan view of the inductor of FIG. 1.

FIG. 2 is a schematic perspective plan view of the inductor of FIG. 1.

Figure 3:
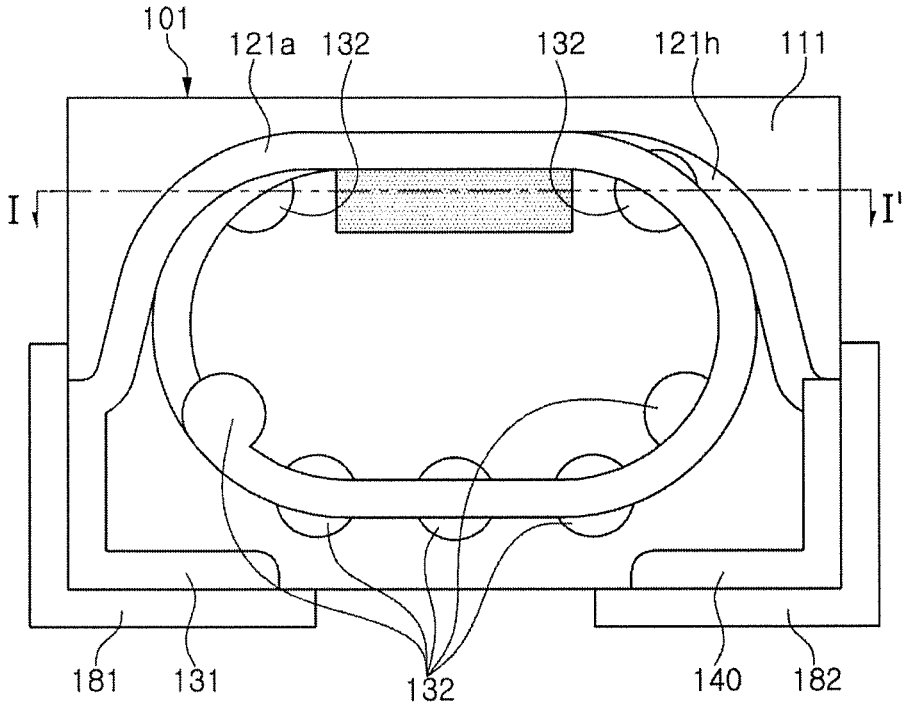
FIG. 3 is a schematic perspective front view of the inductor of FIG. 1.

FIG. 3 is a schematic perspective front view of the inductor of FIG. 1.

Figure 4:
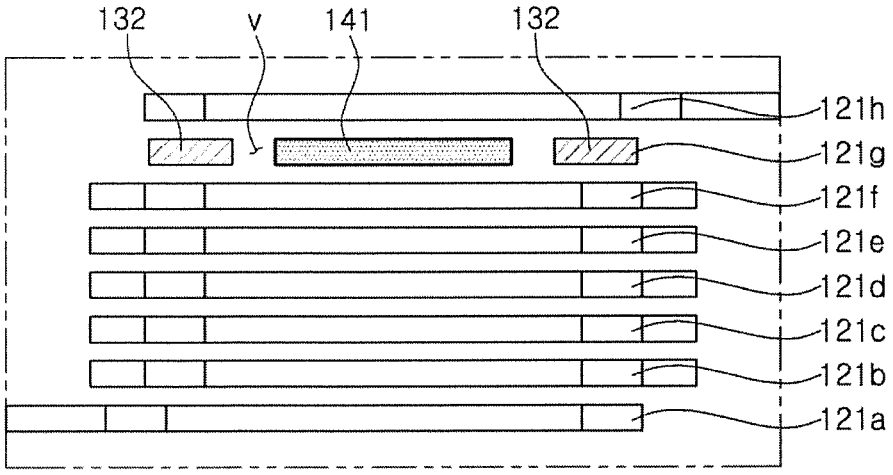
FIG. 4 is a cross-sectional view taken along line I-I' of FIG. 3.

FIG. 4 is a cross-sectional view taken along line I-I' of FIG. 3.

Figure 5:
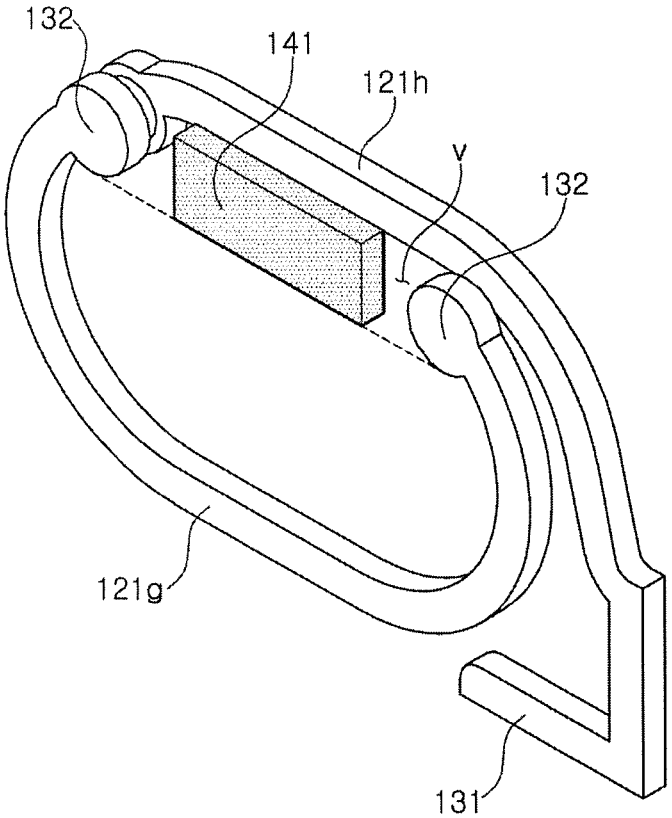
FIG. 5 is a perspective view illustrating a separate coil pattern disposed on an inner side adjacent to a coil pattern disposed on an outer side, among the coil patterns of FIG. 1.

FIG. 5 is a perspective view illustrating a separate coil pattern disposed on an inner side adjacent to a coil pattern disposed on an outer side, among the coil patterns of FIG. 1.

An inductor 100 according to an exemplary embodiment in the present disclosure includes a body 101 in which a plurality of insulating layers 111 on which a plurality of coil patterns 121*a* to 121*h* are arranged are stacked and first and second external electrodes 181 and 182 disposed on an external surface of the body 101. The plurality of coil patterns 121*a* to 121*h* are connected through coil connecting portions 132 and include coil patterns 121*a* and 121*h* disposed on an outer side and coil patterns 121*b* to 121*g* disposed on an inner side thereof. The coil pattern 121*g* disposed on the inner side adjacent to the coil pattern 121*h* disposed on the outer side includes two coil connecting portions 132 spaced apart from each other and facing each other in a length direction L of the body 101. A dummy electrode pattern 141 is further disposed in a void portion v between two coil connecting portions 132.

A structure of the inductor 100 according to an exemplary embodiment in the present disclosure will be described with reference to FIGS. 1 through 3.

The body 101 of the inductor 100 according to an exemplary embodiment in the present disclosure may be formed by stacking a plurality of insulating layers 111 in the first direction (e.g., a width direction W) horizontal to a mounting surface.

The insulating layer 111 may be a magnetic layer or a dielectric layer.

In case where the insulating layer 111 is a dielectric layer, the insulating layer 111 may include $BaTiO_3$ (barium titanate)-based ceramic powder, or the like. In this case, the $BaTiO_3$-based ceramic powder may be, for example, $(Ba_{1-x}Ca_x)TiO_3$, $Ba(Ti_{1-y}Ca_y)O_3$, $(Ba_{1-x}Ca_x)(Ti_{1-y}Zr_y)O_3$, $Ba(Ti_{1-y}Zr_y)O_3$, and the like, prepared by partially employing Ca, Zr, and the like, in $BaTiO_3$, but the present disclosure is not limited thereto.

In case where the insulating layer 111 is a magnetic layer, an appropriate material which may be used as a body of the inductor may be selected as a material of the insulating layer 111, and examples thereof may include resins, ceramics, and ferrite. In this exemplary embodiment, the magnetic layer may use a photosensitive insulating material, whereby a fine pattern may be realized through a photolithography process. That is, by forming the magnetic layer with a photosensitive insulating material, a coil pattern, a coil lead portion 131 and coil connecting portions 132 may be minutely formed to contribute to miniaturization and function improvement of the inductor 100. To this end, the magnetic layer may include, for example, a photosensitive organic material or a photosensitive resin. In addition, the magnetic layer may further include an inorganic component such as $SiO_2/Al_2O_3/BaSO_4$/Talc as a filler component.

First and second external electrodes 181 and 182 may be disposed on an external surface of the body 101.

For example, the first and second external electrodes 181 and 182 may be disposed on a mounting surface of the body 101. The mounting surface refers to a surface facing a printed circuit board (PCB) when the inductor is mounted on the PCB.

The external electrodes 181 and 182 serve to electrically connect the inductor 100 to the PCB when the inductor 100 is mounted on the PCB. The external electrodes 181 and 182 are disposed and spaced apart from each other on the edges of the body 101 in a first direction and in a second direction horizontal to the mounting surface. The external electrodes 181 and 182 may include, for example, a conductive resin layer and a conductive layer formed on the conductive resin layer, but are not limited thereto. The conductive resin layer may include at least one conductive metal selected from the group consisting of copper (Cu), nickel (Ni), and silver (Ag) and a thermosetting resin. The conductive layer may include at least one selected from the group consisting of nickel (Ni), copper (Cu), and tin (Sn). For example, a nickel layer and a tin layer may be sequentially formed.

The coil patterns 121*a* and 121*h* disposed on the outer side, among the plurality of coil patterns 121*a* to 121*h*, may form a coil 120 in which both ends thereof are connected to the first and second external electrodes 181 and 182 through the coil lead portion 131.

The coil patterns 121*a* to 121*h* may be formed on the insulating layers 111.

The coil patterns 121*a* to 121*h* may be electrically connected to adjacent coil patterns by coil connecting portions 132. That is, the helical coil patterns 121*a* to 121*h* are connected by the coil connecting portions 132 to form the coil 120. Both ends of the coil 120 are connected to first and second external electrodes 181 and 182 by the coil lead portion 131, respectively. The coil connecting portions 132 may have a line width larger than the coil patterns 121*a* to 121*h* to improve connectivity between the coil patterns 121*a* to 121*h* and include conductive vias penetrating through the insulating layer 111.

The coil lead portion 131 may be exposed to both longitudinal ends (e.g., opposing surfaces in the length direction) of the body 101 and may also be exposed to a lower surface as a board mounting surface. Accordingly, the coil lead portion 131 may have an L-shape in a cross-section in the length-thickness (L-T) direction of the body 101.

Referring to FIGS. 2 and 3, a dummy lead portion 140 may be formed at a position corresponding to the external electrodes 181 and 182 in the insulating layer 111. The dummy lead portion 140 may serve to improve adhesion between the external electrodes 181 and 182 and the body 101 or may serve as a bridge when the external electrodes 181 and 182 are formed by plating.

The dummy lead portion 140 and the coil lead portion 131 connected to a same one of the external electrodes 181 and 182 may be also connected by a via electrode 142.

The dummy lead portion 140 may be disposed on the plurality of insulating layers 111 on which the coil patterns 121*b* to 121*g* disposed on the inner side are disposed.

The dummy lead portion 140 may be included in the body 101 by forming a pattern having the same shape as that of the coil lead portion 131 on the plurality of insulating layers.

The dummy lead portion 140 may be connected to the coil patterns 121*a* and 121*h* disposed on the outer side of the via electrode 142.

That is, the body 101 according to an exemplary embodiment in the present disclosure may be realized by stacking the plurality of insulating layers on which the coil patterns 121*a* and 121*h* disposed on the outer side are formed and the plurality of insulating layers on which the dummy lead portion 140 is formed, to be adjacent to each other.

Since the plurality of insulating layers on which the dummy lead portion 140 is formed are stacked adjacent to the plurality of insulating layers on which the coil patterns 121*a* and 121*h* disposed on the outer side are formed, a larger number of metal bonds may be formed with the external electrodes 181 and 182 disposed on the side surface of the body 101 in the length direction and the lower surface of the body 101, and thus, adhesion between the coil patterns 121*a* and 121*h* disposed on the outer side and the external electrodes 181 and 182 and adhesion between an electronic component and a printed circuit board (PCB) may be enhanced.

As a material of the coil patterns 121*a* to 121*h*, the coil lead portion 131, the dummy lead portion 140, and the coil connecting portions 132, a conductive material such as copper (Cu), aluminum (Al), silver (Ag), tin (Sn), gold (Au), nickel (Ni), lead (Pb), or an alloy thereof, having excellent conductivity may be used. The coil patterns 121*a* to 121*h*, the coil lead portion 131, the dummy lead portion 140, and the coil connecting portions 132 may be formed by a plating method or a printing method, but the present disclosure is not limited thereto.

The inductor 100 according to the exemplary embodiment in the present disclosure is formed by forming the coil patterns 121*a* to 121*h*, the coil lead portion 131, the dummy lead portion 140, the coil connecting portions 132, and the like, on the insulating layers 111 and subsequently stacking the insulating layers 111 in the first direction horizontal to the mounting surface, and thus, the inductor 100 may be manufactured more easily than the related art. In addition, since the coil patterns 121*a* to 121*h* are arranged to be perpendicular to the mounting surface, magnetic flux may be prevented from being affected by the mounting board.

Referring to FIGS. 2 and 3, in the coil 120 of the inductor 100 according to an exemplary embodiment in the present disclosure, when projected in the first direction, the coil patterns 121*a* to 121*h* overlap each other to form a coil track having one or more coil turns.

Specifically, the first external electrode 181 and the first coil pattern 121*a* are connected by the coil lead portion 131, and thereafter, the first to eighth coil patterns 121*a* to 121*h* are sequentially connected by the coil connecting portions 132.

The eighth coil pattern 121*h* is connected to the second external electrode 182 by the coil lead portion 131.

The second to seventh coil patterns 121*b* to 121*g* disposed on the inner side are connected to each other by the coil connecting portion 132 in the body, without being connected to the coil lead portion 131.

Referring to FIG. 2, among the coil patterns 121*a* to 121*h*, the first and eighth coil patterns 121*a* and 121*h* are coil patterns disposed on the outer side and the second to seventh coil patterns 121*b* to 121*g* are coil patterns disposed on the inner side.

As illustrated in FIG. 2, the coil patterns 121*a* and 121*h* disposed on the outer side refer to coil patterns disposed to be adjacent to opposing side surfaces of the body in the stacking direction of the plurality of coil patterns 121*a* to 121*h*, i.e., in the width direction of the body 101.

Also, the first and eighth coil patterns 121*a* and 121*h*, i.e., the coil patterns 121*a* and 121*h* disposed on the outer side, refer to coil patterns which do not have an adjacent coil pattern in the direction of the opposing side surfaces of the body 101 and which have coil patterns adjacent thereto only in an inward direction.

The coil patterns 121*b* to 121*g* disposed on the inner side refer to a plurality of coil patterns disposed on the inner side of the outer coil patterns 121*a* and 121*h* disposed on the outer side adjacent to the opposing side surfaces of the body 101 in the width direction of the body 101.

The coil patterns 121*a* and 121*h* disposed on the outer side and the coil patterns 121*b* and 121*g* disposed on the inner side adjacent to the coil patterns 121*a* and 121*h* have different pattern shapes.

That is, the second and seventh coil patterns 121*b* and 121*g* adjacent to the first and eighth coil patterns 121*a* and 121*g*, which are coil patterns disposed on the outer side, have a pattern shape different from that of the first and eighth coil patterns 121*a* and 121*h*.

In particular, since the seventh coil pattern 121*g* adjacent to the eighth coil pattern 121*h* has a pattern shape different from that of the eighth coil pattern 121*h*, the void portion v may be formed between the seventh coil pattern 121*g* and the eighth coil pattern 121*h*.

In general, the high frequency inductor is manufactured by forming the coil patterns on the plurality of insulating layers, stacking the layers, and subsequently compressing the same at a high temperature and high pressure.

However, in the process of designing the high frequency inductor, the void portion may be formed between the coil patterns as mentioned above, and when compressing is performed at a high temperature and high pressure as stated above, the coil patterns may be depressed as the void portion is filled with an insulating material.

The depression of the coil patterns may degrade reliability of the inductor and cause a problem in electrical characteristics of the inductor.

According to an exemplary embodiment in the present disclosure, the coil pattern 121*g* disposed on the inner side adjacent to the coil pattern 121*h* disposed on the outer side includes two coil connecting portions 132 spaced apart from each other and facing each other in the length direction of the body 101, and a dummy electrode pattern 141 is further disposed in the void portion v between the two coil connecting portions 132.

That is, the seventh coil pattern 121*g* disposed on the inner side adjacent to the eighth coil pattern 121*h* disposed on the outer side includes two coil connecting portions 132 spaced apart from each other and facing each other in the length direction of the body 101, and the dummy electrode pattern 141 is further disposed in the void portion between the two coil connecting portions 132.

In this manner, since the dummy electrode pattern 141 is further disposed in the void portion v between the two coil connecting portions 132, depression of the coil patterns may be prevented to realize an inductor having excellent reliability.

The dummy electrode pattern 141 may be formed of a material similar to that of the coil patterns 121*a* to 121*h*, the coil lead portion 131, the dummy lead portion 140, and the coil connecting portions 132, and a conductive material having excellent conductivity, such as copper (Cu), aluminum (Al), silver (Ag), tin (Sn), gold (Au), nickel (Ni), lead (Pb), or an alloy thereof may be used as a material of the dummy electrode pattern 141.

The dummy electrode pattern 141 may be formed by a plating method or a printing method but is not limited thereto.

As illustrated in FIG. 2, the coil patterns other than the coil pattern 121*g* disposed on the inner side adjacent to the coil pattern 121*h* disposed on the outer side and including the two coil connecting portions 132 spaced apart from each other and facing each other in the length direction of the body 101 may include one coil connecting portion 132.

That is, the first to sixth coil patterns 121*a* to 121*f* and the eighth coil pattern 121*h*, excluding the seventh coil pattern 121*g* disposed on the inner side adjacent to the eighth coil pattern 121*h* disposed on the outer side may include one coil connecting portion 132 but is not limited thereto.

Referring to FIGS. 4 and 5, a lower portion of the dummy electrode pattern 141 may be positioned to be collinear with lower portions of the two coil connecting portions 132.

According to an exemplary embodiment in the present disclosure, since the lower portion of the dummy electrode pattern 141 is positioned to be collinear with the lower portions of the two coil connecting portions 132, the area of a core disposed inside the coil patterns 121*a* to 121*h* may be secured.

As described above, in the exemplary embodiment in the present disclosure, since the dummy electrode pattern 141 is disposed in the void portion v between the two coil connecting portions 132 and the dummy electrode pattern 141 and the lower portions of the coil connecting portions 132 are disposed to be collinear, there is no change in the area of the core, preventing a reduction in inductance of the inductor. The dummy electrode pattern 141 may be disposed in an upper region of the body 101 in a thickness direction T of the body 101. In this case, a distance from the dummy electrode pattern 141 to the mounting surface (e.g., the surface which first and second external electrodes 181 and 182 extend to) of the inductor 100 may be greater than a distance from a central portion of the inductor 100 to the mounting surface. In other words, the core of the inductor 100 may be disposed between the dummy electrode pattern 141 and the mounting surface of the inductor 100.

In the case of the inductor manufactured according to an exemplary embodiment in the present disclosure, a depression level of the coil patterns may be reduced to about 41.5% compared with the related art inductor, and thus, reliability of the inductor may be improved.

That is, since the dummy electrode pattern 141 is further disposed in the void portion v between the two coil connecting portions 132 of the coil pattern 121*g* disposed on the inner side adjacent to the coil pattern 121*h* disposed on the outer side, a depression level of the coil patterns may be lowered to about 41.5% as compared with the related art inductor, thus enhancing reliability of the inductor.

The number of coil patterns is not limited to that shown in the drawings, and can be less or more than that shown in the drawings. The above descriptions related to the first coil pattern 121*a* and the eighth coil pattern 121*h* may be applied to the outermost coil patterns in an example in which the number of coil patterns are different from that shown in the drawings. In addition, the above descriptions related to the seventh coil pattern 121*g*, the dummy electrode pattern 141, and the eighth coil pattern 121*h* may be applied to two outmost coil pattern layers directly adjacent to each other in such an example, and the above descriptions related to the other inner coil patterns may be similarly applied to other inner coil patterns in such an example.

As set forth above, according to exemplary embodiments in the present disclosure, the dummy electrode pattern is further disposed in the void portion between the coil connecting portions connecting the coil patterns, thereby preventing the coil patterns from being depressed, realizing the inductor having excellent reliability.

While exemplary embodiments have been shown and described above, it will be apparent to those skilled in the art that modifications and variations could be made without departing from the scope of the present disclosure as defined by the appended claims.

What is claimed is:

1. An inductor comprising:

a body in which a plurality of insulating layers on which a plurality of coil patterns are arranged are stacked; and first and second external electrodes disposed on an external surface of the body, wherein the plurality of coil patterns are connected through coil connecting portions and include a first coil pattern and a second coil pattern, the second coil pattern adjacent to the first coil pattern includes two coil connecting portions spaced apart from each other and facing each other in a length direction of the body, on a level of the first coil pattern and on a level of the second coil pattern, the inductor includes only one dummy electrode pattern spaced apart from the first and second external electrodes, and the dummy electrode pattern is disposed between the two coil connecting portions of the second coil pattern.

2. The inductor of claim 1, wherein a lower portion of the dummy electrode pattern is collinear with lower portions of the two coil connecting portions of the second coil pattern.

3. The inductor of claim 1, wherein the second coil pattern has a pattern shape different from a pattern shape of the first coil pattern.

4. The inductor of claim 1, wherein the plurality of coil patterns are stacked vertically with respect to a mounting surface of a board.

5. The inductor of claim 1, wherein the dummy electrode pattern is disposed in an upper region of the body in a thickness direction of the body.

6. The inductor of claim 1, wherein the first and second external electrodes at least extend to a mounting surface of the inductor, and a distance from the dummy electrode pattern to the mounting surface of the inductor is greater than a distance from a central portion of the inductor to the mounting surface.

7. The inductor of claim 1, wherein a coil pattern, other than the second coil pattern, includes one coil connecting portion.

8. The inductor of claim 1, wherein the plurality of coil patterns form a coil in which both ends thereof are connected to the first and second external electrodes through coil lead portions, respectively.

9. The inductor of claim 1, wherein the body further includes a dummy lead portion disposed on the plurality of insulating layers and being in contact with the external surface of the body.

10. The inductor of claim 9, wherein the first coil pattern is one of outermost coil patterns, and the second coil pattern is one of inner coil patterns between the first coil pattern and another of the outermost coil patterns, the dummy lead portion is disposed on the plurality of insulating layers on which the inner coil patterns are disposed.

11. The inductor of claim 1, wherein the dummy electrode pattern is electrically isolated from the plurality of coil patterns.

12. An inductor comprising:

a body in which a plurality of insulating layers on which a plurality of coil patterns are arranged are stacked, the body including an upper surface and a lower surface opposing each other in a thickness direction of the body; and first and second external electrodes disposed on the lower surface of the body and spaced apart from the upper surface of the body, wherein the plurality of coil patterns are connected through coil connecting portions and include outermost coil patterns and inner coil patterns between the outermost coil patterns, one of the inner coil patterns, closest to one of the outermost coil patterns, among the inner coil patterns, includes two coil connecting portions spaced apart from each other and facing each other in a length direction of the body, a dummy electrode pattern is disposed between the two coil connecting portions of the one of the inner coil patterns and is closer to the upper surface than the lower surface, the one of the outermost coil patterns has a single coil connecting portion, among conductive patterns of the inductor, only the dummy electrode pattern is disconnected from the remaining conductive patterns, and the conductive patterns of the inductor include the plurality of coil patterns, the first and second external electrodes, and the coil connecting portions.

13. The inductor of claim 12, wherein a lower portion of the dummy electrode pattern is collinear with lower portions of the two coil connecting portions of the one of the inner coil patterns.

14. The inductor of claim 12, wherein the one of the inner coil patterns has a pattern shape different from a pattern shape of the one of the outermost coil patterns.

15. The inductor of claim 12, wherein the plurality of coil patterns are stacked vertically with respect to a mounting surface of a board.

16. The inductor of claim 12, wherein the first external electrode extends from the lower surface to a first side surface of the body and the second external electrode extends from the lower surface to a second side surface of the body opposing the first side surface, and a distance from the dummy electrode pattern to the lower surface of the body is greater than a distance from a central portion of the inductor to the lower surface.

17. The inductor of claim 12, wherein the plurality of coil patterns form a coil in which both ends thereof are connected to the first and second external electrodes through coil lead portions, respectively.

18. The inductor of claim 12, wherein the body further includes a dummy lead portion disposed on the plurality of insulating layers and being in contact with an external surface of the body.

* * * * *